United States Patent [19]

Zengin

[11] Patent Number: 5,069,867

[45] Date of Patent: Dec. 3, 1991

[54] PROCESS OF MANUFACTURING HIGH-STRENGTH SINTERED MEMBERS

[75] Inventor: Osman Z. Zengin, Gmunden, Austria

[73] Assignee: Miba Sintermetall Aktiengesellschaft, Laakirchen, Austria

[21] Appl. No.: 657,327

[22] Filed: Feb. 19, 1991

[30] Foreign Application Priority Data

Feb. 22, 1990 [AT] Austria ..... 407/90

[51] Int. Cl.[5] ..... G22F 1/00

[52] U.S. Cl. ..... 419/15; 419/23; 419/30; 419/33; 419/47

[58] Field of Search ..... 419/15, 23, 47, 30, 419/33

[56] References Cited

U.S. PATENT DOCUMENTS 3,999,952 12/1976 Kondo et al. ..... 75/246
4,167,582 9/1979 Takahashi et al. ..... 428/457

FOREIGN PATENT DOCUMENTS 0303809 7/1988 European Pat. Off. .
3907886 3/1989 Fed. Rep. of Germany .

*Primary Examiner*—Stephen J. Lechert, Jr.
*Attorney, Agent, or Firm*—Collard, Roe & Galgano

[57] ABSTRACT

To permit an economical manufacture of high-strength sintered members for use in valve timing mechanisms of internal combustion engine by powder metallurgy with liquid-phase sintering, an iron-base powder mixture is provided, which contains 13 to 18% by weight chromium or 3 to 6% by weight molybdenum as a carbide-forming alloying element in the iron alloy powder and also contains 1.5 to 2.6% carbon and 0.4 to 1.0% by weight phosphorus. A corresponding molten iron alloy is atomized into an entraining gas or water jet and is subsequently mixed with the remaining components of the powder.

18 Claims, No Drawings

PROCESS OF MANUFACTURING HIGH-STRENGTH SINTERED MEMBERS

BACKGROUND OF THE INVENTION

1. Field of the Invention

This invention relates to a process of manufacturing high-strength sintered members having a hard-wearing surface, particularly for manufacturing such parts for use in the valve timing mechanisms of internal combustion engines, where at least that portion of said sintered member which is formed with said hard-wearing surface is formed in that a carbon-containing powder mixture, which comprises an iron alloy that contains at least one carbide-forming allowing element of the group VIa of the periodic system, is compacted to form a compact, which is then subjected to liquid-phase sintering.

2. Description of the Prior Art

In order to provide cams for use on a camshaft or other members of valve timing mechanisms of internal combustion engines, which cams or other members meet stringent requirements regarding their wear resistance and fatigue strength, it is known (EP-A-303 809) to make such members in that a powder mixture is compacted which comprises an iron alloy powder that contains carbide-forming alloying elements of the groups Vb and VIb of the periodic system, and graphite powder in the amount which is required for a formation of carbides. The compacts are then sintered at a temperature which slightly exceeds the solidus temperature and the compact which has thus been subjected to liquid-phase sintering is compacted to at least 99% of its theoretical density by isostatic hot pressing. A major disadvantage of that known process resides in that the isostatic hot pressing of the presintered compacts involves a considerable expenditure but such isostatic pressing is essential to ensure a uniform distribution of the carbides at the required density. Whereas sintering at a sintering temperature slightly above the solidus temperature permits a uniform distribution of carbides, this will be possible only with a comparatively high void ratio. Besides, it is not possible to use lower-melting alloying elements owing to the high temperatures which are required for hot pressing and such lower-melting elements would melt at the pressing temperatures and would then emerge through the still existing pores during the pressing operation.

It is finally known from DE-A-3 907 886) that the cams of a camshaft may be made to have a hard-wearing external layer and a cam body by a powder-metallurgical process, which comprises liquid-phase sintering and in which the law compacts, which differ in their shrinking behavior, are fitted onto a steel shaft, so that a strong bond is obtained between the hard-wearing layer and the cam body and between the cam body and the steel shaft when the sintering has been performed. In that case the hard-wearing external layer is constituted by an iron-carbon-nickel-chromium-molybdenum alloy. But that alloy will not withstand high loads because, for instance, nickel cannot form carbides, which would be essential for a high wear resistance, and nickel-containing materials tend to form austenite so that the fatigue strength is reduced.

SUMMARY OF THE INVENTION

It is an object of the invention to make high-strength sintered members, particularly for use in the valve timing mechanisms of internal combustion engines, by a process which includes liquid-phase sintering whereas isostatic hot pressing is not required.

In a process of the kind described first hereinbefore that object is accomplished in accordance with the invention in that the powder mixture contains 13 to 18% by weight chromium or 3 to 6% by weight of at least one component of the group consisting of molybdenum or of molybdenum and tungsten or contains corresponding amounts of said components, as a carbide-forming alloying constituent of that iron alloy powder and also contains 1.5 to 2.6% by weight added carbon and 0.4 to 1.0% by weight phosphorus, the iron alloy powder is produced in that a molten iron alloy is atomized into an entraining gas or water jet, and said iron alloy powder is subsequently mixed with the other components of the powder.

The relatively high carbon content which is employed ensures a satisfactory formation of carbides and the formation of a liquid phase in a sufficiently large amount during the sintering. This is not only due to the carbon content but also to the fact that the addition of phosphorus results in a much lower sintering temperature so that a uniform distribution of carbides can be expected. The large proportion of the liquid phase will also ensure that the sintered member has the required density without a need for a subsequent hot pressing.

Particularly desirable conditions will be established if 1.0 to 2.3% by weight tin and 15 to 20% by weight copper are incorporated in the powder mixture because the copper will bind a part of the carbon so that here will be no risk of a formation of cementite, which would decrease the fatique strength by a formation of cementite caused by the higher carbon content. Besides, the bronze phase which is composed of copper and tin will act as a lubricant so that the sliding friction of the sintered member will be reduced; the bronze phase will also tend to fill the pores during the sintering operation.

To ensure that the distribution of carbides has a uniformity which will promote the wear resistance it is essential that the carbide-forming elements are also uniformly distributed in the powder mixture. To that end the carbide-forming element is included as an alloying element in the iron alloy powder, which is produced in that the molten alloy is atomized into an entraining jet of gas or water. If chromium is used as a carbide-forming alloying element, 0.7 up to 1.5% by silicon, preferably in the form of ferrosilicon, must be added to the molten iron alloy as a killing agent and to improve the atomization of the molten alloy. If molybdenum is used as a carbide-forming alloying element, silicon will desirably be replaced by up to 0.4% by weight manganese.

In order to ensure that the iron powder can easily be compacted and that it has a sufficiently large particle surface area for the sintering operation, the iron alloy powder is required to consist of dendritic particles and at least 70% by weight of the powder particles are required to have an individual particle mean diameter of less than 50 μm whereas the remaining particles of the powder should have an individual particle mean diameter not in excess of 100 μm. In a powder having such a particle size composition an optimization can be achieved by the fact that the use of extremely fine powders will improve the sintering conditions because the interfacial area between individual powder particles will be increased and the remaining pores will be decreased in size and that a decreasing particle size will increase the cost of producing the powder.

The carbon content may be provided by a powder that consists of natural graphite or electrographite and has an individual particle mean diameter not in excess of 5 μm so that the carbon can be provided in the fine distribution which is required for the formation of carbides. The phosphorus, which together with the carbon is essential for the result to be produced in accordance with the invention, may be added to the molten iron alloy as ferrophosphorus and in that case will be atomized together with the molten iron alloy into the entraining gas or water jet. Alternatively the phosphorus may be admixed as a ferrophosphorus powder to the iron alloy powder, in the latter case each particle should have a mean diameter below 10 μm. The admixing of a ferrophosphorus powder will result in a faster diffusion of the phosphorus into the iron matrix so that a formation of larger secondary pores by diffusing phosphorus will be prevented.

The copper powder may desirably consist of electrolytic copper in the form of dendritic particles having an individual particle mean diameter not in excess of 5 μm so that the copper together with the tin, which is required to have an individual particle mean diameter not in excess of 20 μm, will form a uniformly distributed bronze phase and segregation will be avoided.

The molybdenum may be replaced by tungsten as a carbide-forming element and in that case a molybdenum-containing iron alloy powder may be replaced at a ratio of 1:2 by an iron alloy powder that contains 6 to 12% by weight tungsten. The content of tungsten used as an alloying element must not exceed 12% by weight so that compacts having a sufficiently high green strength will be obtained. But in addition to the iron alloy powder which contains up to 6% by weight molybdenum, the powder mixture may contain 1 to 2% by weight tungsten powder so that the wear resistance will be improved further by tungsten carbides.

It has been stated hereinbefore that a uniform distribution of the component powders in the powder mixture is of high importance. For this reason the copper and tin powders and optionally also the phosphorus powder may be admixed first to the iron alloy powder and the resulting mixture may then be mixed with the carbon powder to provide a master mixture, to which a conventional lubricant powder may be admixed. If mixing is effected in that sequence, a segregation particularly of the very fine carbon powder will effectively be prevented, as is required for a uniform distribution of carbides.

The resulting powder mixture is then optionally granulated and under a compacting pressure between 700 and 800 MPa is compacted to form compacts having a density between 6.5 and 6.6 g/cm$^3$ and is subsequently annealed so that the lubricant usually consisting of wax is removed from the compact and the oxygen content is decreased below a limit of 1800 ppm. That annealing can preferably be effected by a presintering, which is carried out at temperatures between 850° and 950° C. and which will increase the green strength. The density of the compact should not be in excess of 6.7 g/cm$^3$ because the carbon monoxide produced by the sintering otherwise could not escape and would form blisters. A density of the compact below 6.4 g/cm$^3$ will adversely affect the green strength.

EXAMPLE 1

For a powder-metallurgical manufacture of the cams of a camshaft, an iron alloy powder which contained 6% by weight molybdenum and had been atomized into an entraining water jet was prepared. The powder had an individual particle mean diameter not in excess of 75 μm. 70% by weight of said particles had an individual particle mean diameter below 50 μm. After the powder had been atomized and had been reduced under a hydrogen-nitrogen atmosphere, the iron alloy powder was found still to contain about 5000 ppm oxygen. 0.45% by weight phosphorus in the form of a very fine ferrophosphorus powder, which contained 16% phosphorus and had an individual particle mean diameter below 10 μm, was admixed to that iron alloy powder in a double-cone mixer for a mixing time of about 5 minutes. In a succeeding mixing operation for 5 minutes, 1.85% by weight carbon was admixed in the form of a finely ground natural graphite powder having an individual particle mean diameter below 5 μm. Before the succeeding compacting operation, 0.5% by weight wax as a lubricant for assisting the compacting was admixed to the stock mixture and the resulting powder mixture was then compacted under a pressure of 700 MPa to form compacts having a density of 6.5 g/cm$^3$. Said compacts were reduced for 2 hours at a temperature of 950° C. under a protective gas atmosphere of hydrogen and nitrogen at a ratio of 1:3. Thereafter it was found that the oxygen content amounted to 1500 ppm and the carbon content to 1.6% by weight. For liquid-phase sintering, the thus pretreated compacts were heated in a vacuum furnace at a sintering temperature of 1075° C. for 2 hours.

The sintering in a vacuum furance might be replaced by a sintering in a belt conveyor furnace under a protective gas atmosphere composed of hydrogen and nitrogen at a ratio of 1:5 with high economy.

The sintered compacts exhibited a shrinkage of about 7% and had 98% of their theoretical density. Hardness measurements revealed a hardness of HRC 42±2. The molybdenum carbides were found to be very uniformly distributed in the iron matrix. The carbides were spherical and had diameters between 3 and 7 μm so that a very high wear resistance was ensured. The remaining pores were also spherical and were not in excess of 50 μm in diameter so that a high fatigue strength was ensured.

The hardening treatment succeeding the sintering operation may be performed in various ways, namely, by a hardening in the vacuum furnace used also for the sintering or in a belt conveyor furnace under a controlled atmosphere or by oil hardening. The hardened compacts had a hardness of HRC 63±1, which after a tempering treatment at 550° C. for 2 hours had decreased to HRC 51±1. The cams thus made had a high wear resistance and a high fatigue strength and also had a high retentivity of hardness.

EXAMPLE 2

For a manufacture of cams, a dendritic iron alloy powder was provided, which contained 18.0% chromium and had been atomized into an entraining water jet and which contained 0.9 to 1.1% silicon to improve the atomizing. Just as in the preceding example the stated percentages by weight are based on the total powder mixture. The particle size was the same as in Example 1. After a reduction under an atmosphere of nitrogen and hydrogen the oxygen content was found to amount to 2400 ppm.

17.0% by weight electrolytic copper having an individual particle mean diameter below 5 μm, 1.2% by weight tin powder having an individual particle mean diameter below 20 μm, 2.5% by weight dendritic ferrophosphorus powder containing 16% phosphorus and having an individual particle mean diameter below 10 μm, 2.6% by weight of a very fine graphite powder, 0.5% by weight wax as a compacting aid and 0.8% molybdenum powder to improve the through hardening were added to that iron alloy powder. Mixing was again effected in steps. The ferrophosphorus powder, copper, tin and molybdenum powders were first admixed to the iron alloy powder before the graphite powder and subsequently the wax powder were admixed. That powder mixture was compacted under a pressure of 800 MPa to make compacts having a density of 6.6 g/cm$^3$. The precompacted compacts were reduced at a temperature of 950° C. under a protective gas atmosphere of hydrogen and nitrogen at a ratio of 1:15 for 2 hours and were subsequently found to contain 1750 ppm oxygen and 2.5% by weight carbon. The compacts were subsequently sintered in a vacuum furnace at a temperature of 1080° C. for two hours. Just as in Example 1 a pressure of $4\times10^{-2}$ millibars was maintained in the vacuum furnace. Alternatively, sintering may be effected in a conveyor belt furnace under a protective gas atmosphere composed of hydrogen and nitrogen at a ratio of 3:10. The sintered members exhibited a shrinkage of about 5.5 to 6.0% and had a density of 97 to 98% of the theoretical density. A hardness of HRC 39.0±1 was measured. Owing to the spherical chromium carbides having a size of 5 to 10 μm the members had a very high wear resistance. The uniform distribution of the bronze phase composed of the copper and tin resulted in an excellent running-in behavior and in a low sliding friction. A segregation of copper was not detected. Hardening was effected in a vacuum furnace or in a conveyor belt furnace at 1040° C. for one hour and increased the hardness to HRC 54±1. After a tempering at 550° C. for 2 hours, a hardness of HRC 50±1 was measured.

I claim:

1. In a process of manufacturing a high-strength sintered member, comprising providing a carbon-containing powder mixture comprising an iron alloy powder, which contains at least one carbide-forming alloying element of group VIb of the periodic system, compacting said powder mixture to form a compact, and subjecting said compact to liquid-phase sintering, the improvement residing in that said powder mixture is provided to comprise an iron alloy powder containing at least one carbide-forming alloying element selected from the group consisting of chromium in an amount of 13 to 18% by weight, molybdenum in an amount of 3 to 6% by weight, molybdenum and tungsten in a total amount which is equivalent to 3 to 6% by weight molybdenum, and a combination of at least two of said alloying elements in corresponding proportions, based on the total weight of the powder mixture, said powder mixture also contains 0.4 to 1.0% by weight phosphorus and at least one additional component powder including 1.5 to 2.6% by weight added carbon powder, said iron alloy powder is produced in that a molten alloy iron alloy is atomized in an entraining fluid jet and said at least one additional component powder is subsequently admixed to said iron alloy powder thus produced.

2. The improvement set forth in claim 1, wherein said molten alloy is atomized into an entraining gas jet.

3. The improvement set forth in claim 1, wherein said molten iron alloy is atomized into an entraining water jet.

4. The improvement set forth in claim 1, wherein said iron alloy powder contains molybdenum and tungsten as carbide-forming alloying elements in a total amount which is equivalent to 3 to 6% by weight molybdenum, provided that two parts by weight tungsten are regarded as an equivalent of 1 part by weight of molybdenum.

5. The improvement set forth in claim 1, wherein said powder mixture also contains 1.0 to 2.5% by weight tin and 15 to 20% by weight copper.

6. The improvement set forth in claim 5, wherein said copper and zinc are admixed in powder form to said iron alloy powder before said carbon powder.

7. The improvement set forth in claim 1, wherein said iron alloy powder comprises chromium as an alloying element and said molten iron alloy contains 0.7 to 1.5% by weight silicon.

8. The improvement set forth in claim 1, wherein said iron alloy powder contains molybdenum as an alloying element and said molten iron alloy contains up to 1.0% by weight manganese.

9. The improvement set forth in claim 1, wherein said iron alloy powder consists of dendritic particles, at least 70% by weight of said particles have a individual particle mean diameter below 50 μm and the remaining ones of said particles have an individual particle mean diameter not in excess of 100 μm.

10. The improvement set forth in claim 1, wherein said carbon powder is selected from the class consisting of natural graphite powder and electrographite powder and has an individual particle mean diameter not in excess of 5 μm.

11. The improvement set forth in claim 1, wherein said phosphorus is added in the from of ferrophosphorus to said molten iron alloy.

12. The improvement set forth in claim 1, wherein said at least one additional component powder comprises a ferrophosphorus powder, which contains said phosphorus and which has an individual particle mean diameter below 12 μm.

13. The improvement set forth in claim 1, wherein said powder mixture also contains 15 to 20% by weight electrolytic copper powder consisting of dendritic particles having an individual particle mean diameter not in excess of 5 μm.

14. The improvement set forth in claim 1, wherein said powder mixture also contains 1.0 to 2.5% by weight tin powder having an individual particle mean diameter not in excess of 20 μm.

15. The improvement set forth in claim 1, wherein said iron alloy powder contains 6 to 12% by weight tungsten as a carbide-forming alloying element.

16. The improvement set forth in claim 1, wherein said powder mixture contains 1 to 2% by weight tungsten powder.

17. The improvement set forth in claim 1, wherein 1.0 to 2.5% tin powder and 15 to 20% by weight copper powder, based on the total weight of said powder mixture, are added to said iron alloy powder before said carbon powder is added thereto.

18. The improvement set forth in claim 17, wherein said at least one additional component powder comprises a ferrophosphorus powder, which contains said phosphorus and is admixed to said iron alloy powder after said zinc and copper powders and before said carbon powder.

* * * * *